US009387536B2

(12) United States Patent
Enomura

(10) Patent No.: US 9,387,536 B2
(45) Date of Patent: Jul. 12, 2016

(54) METHOD FOR PRODUCING METAL MICROPARTICLES

(75) Inventor: Masakazu Enomura, Izumi (JP)

(73) Assignee: M. TECHNIQUE CO., LTD., Izumi-Shi (JP)

( * ) Notice: Subject to any disclaimer, the term of this patent is extended or adjusted under 35 U.S.C. 154(b) by 212 days.

(21) Appl. No.: 14/001,888

(22) PCT Filed: Mar. 14, 2011

(86) PCT No.: PCT/JP2011/055976
§ 371 (c)(1),
(2), (4) Date: Aug. 28, 2013

(87) PCT Pub. No.: WO2012/124046
PCT Pub. Date: Sep. 20, 2012

(65) Prior Publication Data

US 2013/0333520 A1 Dec. 19, 2013

(51) Int. Cl.
*B22F 9/24* (2006.01)

(52) U.S. Cl.
CPC ..... *B22F 9/24* (2013.01); *B22F 2301/15* (2013.01); *B22F 2301/255* (2013.01); *B22F 2301/30* (2013.01)

(58) Field of Classification Search
None
See application file for complete search history.

(56) References Cited

U.S. PATENT DOCUMENTS

2009/0025510 A1 1/2009 Lee et al.
2010/0009191 A1 1/2010 Kuba et al.

(Continued)

FOREIGN PATENT DOCUMENTS

EP 2177294 A1 4/2010
EP 2184110 A1 5/2010
EP 2193865 A1 6/2010

(Continued)

OTHER PUBLICATIONS

Dang et al., "Synthesis and optical properties of copper nanoparticles prepared by a chemical reduction method," Advances in Natural Sciences: Nanoscience and Nanotechnology, vol. 2, No. 1, Mar. 7, 2011, pp. 1-6.

(Continued)

*Primary Examiner* — George Wyszomierski
(74) *Attorney, Agent, or Firm* — Birch, Stewart, Kolasch & Birch, LLP

(57) ABSTRACT

Provided is a producing method for metal microparticles for which the particle diameter is controlled. At least two types of fluids to be processed are used, and at least one of those fluids to be processed is a metallic solution wherein a metal and/or metallic compound is dissolved in a solvent. Of the fluids to be processed other than the above, at least one is a reducing agent fluid that includes a reducing agent. The fluids to be processed are mixed in a thin film fluid created between at least two processing surfaces (1, 2) which are disposed to face each other and can be brought closer or separated, at least one face rotating relative to the other, and metal microparticles for which the particle diameter is controlled are precipitated out. At that time, the particle diameter of the metal microparticles is controlled by varying particular conditions for at least one of the metallic solution and the reducing agent fluid introduced between the processing surfaces (1, 2). The particular conditions are at least one type selected from a set comprising the introduction rate for the metallic solution and/or reducing agent fluid and the pH of the metallic solution and/or the reducing agent fluid.

4 Claims, 5 Drawing Sheets

(56) References Cited

U.S. PATENT DOCUMENTS

| | | | |
|---|---|---|---|
| 2010/0155310 | A1 | 6/2010 | Enomura |
| 2010/0327236 | A1 | 12/2010 | Enomura |

FOREIGN PATENT DOCUMENTS

| | | | |
|---|---|---|---|
| JP | 63-312906 | A | 12/1988 |
| JP | 4-333504 | A | 11/1992 |
| JP | 2002-294312 | A | 10/2002 |
| JP | 2007-308765 | A | 11/2007 |
| JP | 2008-50697 | A | 3/2008 |
| JP | 2009-24254 | A | 2/2009 |
| JP | 2009-144250 | A | 7/2009 |
| JP | 2011-6770 | A | 1/2011 |
| WO | 2009/008390 | A1 | 1/2009 |
| WO | WO-2009041274 | A1 * | 4/2009 |

OTHER PUBLICATIONS

Du et al., "Controlled platinum nanoparticles uniformly dispersed on nitrogen-doped carbon nanotubes for methanol oxidation," Diamond and Related Materials, vol. 17, No. 4-5, Feb. 14, 2008, pp. 535-541.

* cited by examiner

METHOD FOR PRODUCING METAL MICROPARTICLES

The present invention relates to a method for producing metal microparticles.

BACKGROUND ART

In recent years, a metal microparicle has been wanted in wide fields such as a catalyst, a conductive material, a magnetic material, a secondary electron releasing material, a luminescent material, a heat absorber, an energy storage material, an electrode material, and a coloring material; and a metal microparticle having suitable particle diameter for its purpose has been considered to be necessary. Both a precious metal and a non-precious metal have been receiving an attention; and for example, nickel, a typical non-precious metal, is being widely used as a magnetic material for a magnetic recording medium and the like, a catalyst, a laminated ceramic condenser, an inner conductive material of a substrate, an electrode material, and so forth. Especially in view of a thermal shrinkage property of a metal, a metal microparticle having narrow particle diameter distribution is wanted; and in accordance with its performance and ease in handling, metal micorparticles having different particle diameters need to be produced selectively. In view of the above, in order to industrially utilize a metal microparticle, not only a method for producing it stably with a large scale but also a method with which a metal microparticle having a particle diameter thereof controlled can be produced highly precisely and efficiently is eagerly wanted.

There are many methods for producing a metal microparticle; in a gas phase method, a method such as spray pyrolysis of a solution that contains a metal ion, shown in the Patent Document 1, is generally used. However, in this method, it is difficult to produce particles having uniform particle diameter and crystal type; and in addition, there are problems of a large manufacturing equipment, a high energy cost, and so forth. In a liquid phase method, a method such as a so-called polyol reduction is generally known as shown in the Patent Document 2; in this method, however, specific means to control particle diameter of the particles to be produced has not been reported. Especially in a batch process thereof, it is difficult to obtain uniform particle diameter thereby causing problems such as generation of the problematic coarse particles and classification thereof; and therefore, control of the particle diameter of metal particles has been very difficult.

Applicant of the present invention provided a method for producing a metal microparticle such as the one reported in the Patent Document 3; however, a specific method for controlling the particle diameter of metal microparticles to be produced has not been disclosed in the Patent document 3.

PRIOR ART DOCUMENTS

Patent Document

Patent Document 1: Japanese Patent Laid-Open Publication No. 2002-294312

Patent Document 2: Japanese Patent Laid-Open Publication No. 2009-24254

Patent Document 3: International Patent Laid-Open Publication No. 2009/008390

DISCLOSURE OF INVENTION

Problems to be solved by the Invention

In view of the situation mentioned above, the present invention has an object to provide a method for producing a metal microparticle having a particle diameter thereof controlled.

Means for Solving the Problems

Inventors of the present invention carried out an extensive investigation, and as a result of it, they found that, on the occasion to separate a metal microparticle by mixing as fluids to be processed a metal solution in which any one of a metal and a metal compound or both are dissolved with a reducing fluid in which a reducing agent is contained between processing surfaces which are disposed in a position they are faced with each other so as to be able to approach to and separate from each other, at least one of which rotates relative to the other, a metal microparticle having a particle diameter thereof controlled can be obtained by changing a specific condition with regard to at least any one of the metal solution and the reducing fluid; and based on this finding, the present invention could be accomplished.

An invention according to the present application provides a method for producing a metal microparticle, in which at least two kinds of fluid to be processed are used, of these at least one fluid to be processed is a metal solution in which at least one kind of a metal and a metal compound or both are dissolved in a solvent, and at least one fluid to be processed which is different from the foregoing solution is a reducing fluid in which at least one kind of a reducing agent is contained, and further, these fluids to be processed are mixed in a thin film fluid formed between at least two processing surfaces which are disposed in a position they are faced with each other so as to be able to approach to and separate from each other, at least one of which rotates relative to the other, thereby separating the metal microparticle having a particle diameter thereof controlled, wherein this particle diameter is controlled by changing a specific condition with regard to at least any one of the metal solution and the reducing fluid to be introduced into between the at least two processing surfaces, wherein the specific condition is at least one condition selected from the group consisting of an introduction velocity of at least any one of the metal solution and the reducing fluid and pH of at least any one of the metal solution and the reducing fluid.

As to the change of the specific condition with regard to at least any one of the metal solution and the reducing fluid to be introduced into between at least two processing surfaces, control of the introduction velocity into between the processing surfaces may be done specifically by the following (1) to (3), and control of pH may be done specifically by the following (4) to (6). For this, a combination of each control of the introduction velocity by (1) to (3) and each control of pH by (4) to (6) may be used.

(1) Introduction velocity of at least one metal solution into between the processing surfaces is changed.

(2) Introduction velocity of at least one reducing fluid into between the processing surfaces is changed.

(3) Both introduction velocities of at least one metal solution and at least one reducing fluid into between the processing surfaces are changed.

(4) A pH of at least one metal solution is changed.

(5) A pH of at least one reducing fluid is changed.

(6) Both pH of at least one metal solution and at least one reducing fluid are changed.

Elements that constitute the metal microparticle of the present invention are preferably all metal elements in the periodic table; and in addition to these metal elements, B, Si, Ge, As, Sb, C, N, O, S, Te, Se, F, Cl, Br, I, and At may be mentioned.

According to mere one embodiment of the present invention, the present invention may be carried out as a method for producing a metal microparticle, wherein the method comprises:

a fluid pressure imparting mechanism for imparting a pressure to a fluid to be processed, a first processing member provided with a first processing surface of the at least two processing surfaces, a second processing member provided with a second processing surface of the at least two processing surfaces, and a rotation drive mechanism for rotating these processing members relative to each other; wherein each of the processing surfaces constitutes part of a sealed flow path through which the fluid to be processed under the pressure is passed, of the first and the second processing members, at least the second processing member is provided with a pressure-receiving surface, and at least part of this pressure-receiving surface is comprised of the second processing surface, the pressure-receiving surface receives a pressure applied to the fluid to be processed by the fluid pressure imparting mechanism thereby generating a force to move in the direction of separating the second processing surface from the first processing surface, the fluid to be processed under the pressure is passed between the first processing surface and the second processing surface which are disposed in a position they are faced with each other so as to be able to approach to and separate from each other, at least one of which rotates relative to the other, whereby the fluid to be processed forms a thin film fluid, and a metal microparticle having a particle, diameter thereof controlled is separated in this thin film fluid.

According to mere another embodiment of the present invention, the present invention may be carried out as a method for producing a metal micropartilce, wherein at least one fluid of the fluids to be processed passes through between both the processing surfaces while forming the thin film fluid, an another introduction path independent of the flow path for the foregoing at least one fluid is provided, at least one opening leading to this introduction path is arranged in at least any one of the first processing surface and the second processing surface, at least one fluid which is different from the foregoing at least one fluid is introduced into between the processing surfaces through this opening, the fluids to be processed are mixed in the thin film fluid, and a metal microparticle having a particle diameter thereof controlled is separated in this thin film fluid.

Advantages

The present invention made it possible to control the particle diameter of metal microparticles as well as to simply and continuously produce metal microparticles having the particle diameter thereof controlled, both of them having been difficult by conventional production methods. In addition, because it became possible to control the particle diameter of metal microparticles by simple change of their treatment conditions, it became possible to selectively produce metal microparticles having different particle diameters with lower cost and energy than ever; and thus, the metal microparticles can be provided cheaply and stably.

Figure 4:
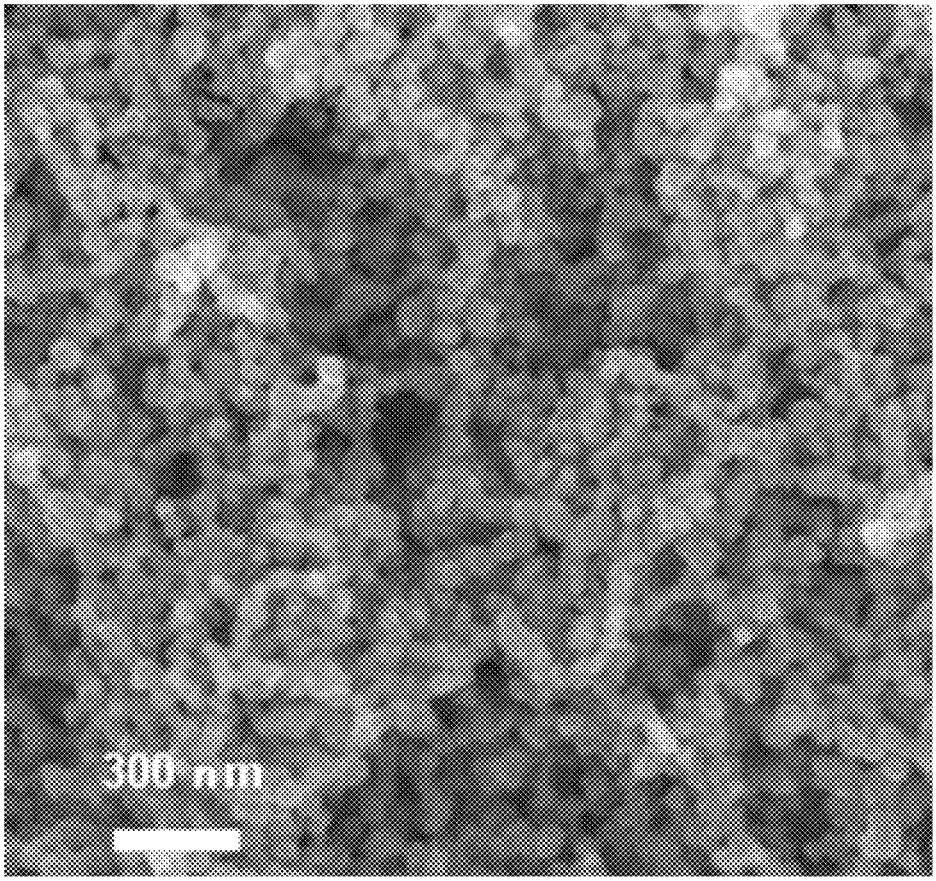

FIG. 4 This shows a SEM picture of nickel microparticles produced in Example 1 of the present invention.

Figure 5:
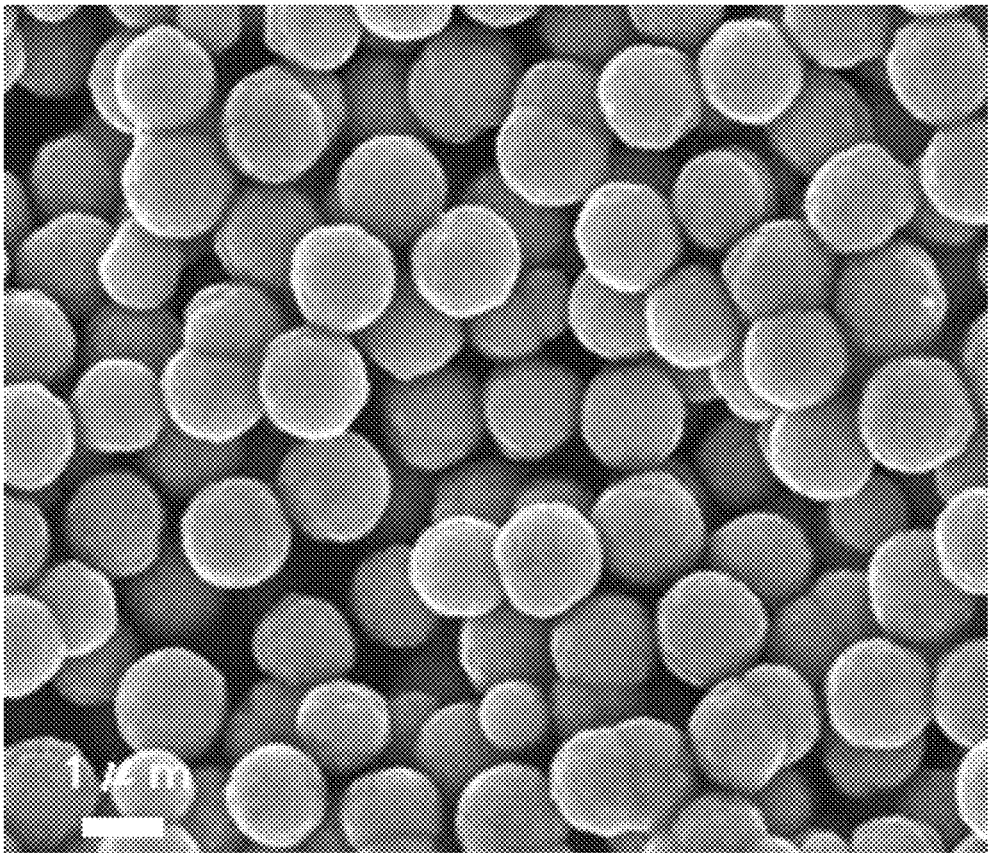

FIG. 5 This shows a SEM picture of nickel microparticles produced in Example 8 of the present invention.

Hereunder, one embodiment of the present invention will be specifically explained.

Metals:

The metal solution in the present invention is the solution in which any one of a metal and a metal compound or both are dissolved in a solvent.

Metals in the present invention are not particularly restricted. Preferably, all metal elements in the periodical table may be used. Illustrative example of the metal element includes Ti, Fe, W, Pt, Au, Cu, Ag, Pb, Ni, Mn, Co, Ru, V, Zn, Zr, Sn, Ta, Nb, Hf, Cr, Mo, Re, In, Ir, Os, Y, Tc, Pd, Rh, Sc, Ga, Al, Bi, Na, Mg, Ca, Ba, La, Ce, Nd, Ho, and Eu. In addition to these metal elements, non-metal elements of B, Si, Ge, As, Sb, C, N, O, S, Te, Se, F, Cl, Br, I, and At may be used in the present invention. These metals may be constituted of a single element; or an alloy formed of a plurality of metal elements or a substance which contains a metal element and a non-metal element may be used. Naturally, an alloy formed of a precious metal and a non-precious metal may be used.

Metal Compounds:

A metal solution in which a metal compound of these metals, in addition to a single element of the foregoing metals (including non-metal elements mentioned above), is dissolved in a solvent may be used as the metal solution. The metal compound of the present invention is not particularly restricted; and illustrative example thereof includes metal compounds in the form of a metal salt, an oxide, a hydroxide, a hydroxylated oxide, a nitride, a carbide, a complex, an organic salt, an organic complex, an organic compound, and a hydrate and an organic solvent adduct of them. The metal salt is not particularly restricted; and illustrative example thereof includes a nitrate, a nitrite, a sulfate, a sulfite, a formate, an acetate, a phosphate, a phosphite, a hypophosphite, a chloride, an oxysalt, an acetylacetonato salt, and a hydrate or an organic solvent adduct of these metal salts. Illustrative example of the organic compound includes a metal alkoxide. These metal compounds may be used singly or as a mixture of two or more of them. It is preferable that any one of the metal and the metal compound or both mentioned above be used as a metal solution in which these are dissolved in a solvent as mentioned later.

Reducing Agents:

The reducing agent used in the present invention is a substance capable of reducing any one of a metal and a metal compound or both that are contained in the metal solution, and is not particularly restricted; though a substance capable of reducing a metal ion is preferable. Illustrative example thereof includes hydrazine, hydrazine monohydrate, formaldehyde, sodium sulfoxylate, a boron hydride metal salt, an aluminum hydride metal salt, a triethylboron hydride metal salt, glucose, citric acid, ascorbic acid, tannic acid, dimethylformamide, pyrogallol, tetrabutylammonium borohydride, sodium hypophosphite ($NaH_2PO_2 \cdot H_2O$), Rongalite C ($NaHSO_2 \cdot CH_2O \cdot 2H_2O$), and a metal compound or an ion thereof, preferably a transition metal or an ion thereof, such as iron and titanium. The foregoing reducing agents include those in the form of a hydrate, an organic solvent adduct, and an anhydrous compound thereof. These reducing agents each may be used singly or as a mixture of two or more of them.

The reducing fluid in the present invention shall contain at least one foregoing reducing agent. These reducing agents may be used as the reducing fluid obtained by mixing with or dissolving in a solvent as mentioned later. The reducing fluid includes a fluid which is in the state of dispersion solution or slurry for use.

Solvents:

The solvent to be used in the present invention is not particularly restricted; and illustrative example thereof includes water such as an ion-exchanged water, a RO water, a pure water, and a ultrapure water; alcoholic organic solvents such as methanol and ethanol; polyol organic solvents (polyvalent alcohols) such as ethylene glycol, propylene glycol, trimethylene glycol, triethylene glycol, polyethylene glycol, and glycerin; ketonic organic solvents such as acetone and methyl ethyl ketone; ester organic solvents such as ethyl acetate and butyl acetate; ether organic solvents such as dimethyl ether and dibutyl ether; aromatic organic solvents such as benzene, toluene, and xylene; and aliphatic hydrocarbon organic solvents such as hexane and pentane. If the foregoing alcoholic organic solvents or polyol organic solvents are used as the solvent, there is a merit that these solvents can act also as the reducing agent. These solvents each may be used singly or as a mixture of two or more of them.

Fluid Processing Apparatus:

In the present invention, it is preferable that mixing of the metal solution in which at least any one of a metal and a metal compound or both are dissolved in a solvent with a reducing fluid in which at least one reducing agent is contained be done by stirring and mixing in a thin film fluid formed between processing surfaces which are disposed in a position they are faced with each other so as to be able to approach to and separate from each other, at least one of which rotates relative to the other; and thus, for example, it is preferable that the metal microparticle be separated by mixing by using an apparatus based on the same principle as the apparatus shown in the Patent Document 3 filed by the present applicant. By using the apparatus based on the principle like this, the metal microparticle having particle diameter thereof controlled uniformly and homogeneously can be produced.

Hereinafter, embodiments of the above-mentioned fluid processing apparatus will be explained by using the drawings.

Figure 1:
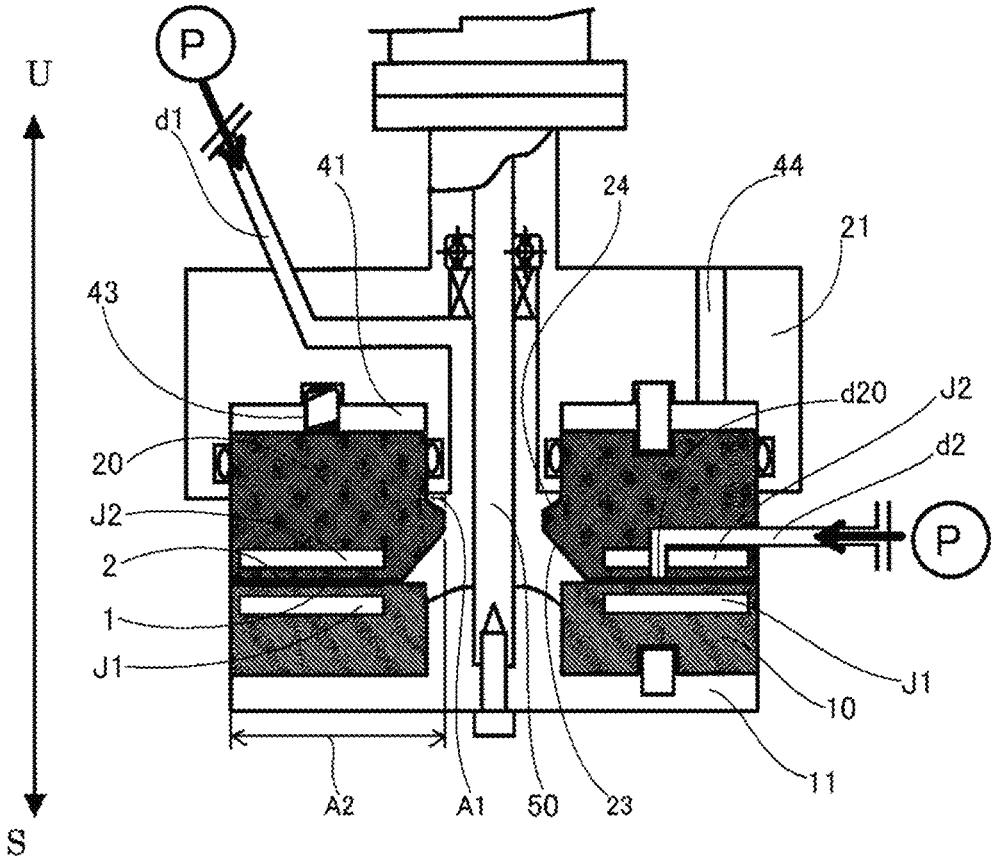
FIG. 1 is a schematic sectional view showing the fluid processing apparatus according to an embodiment of the present invention.
Figure 2:
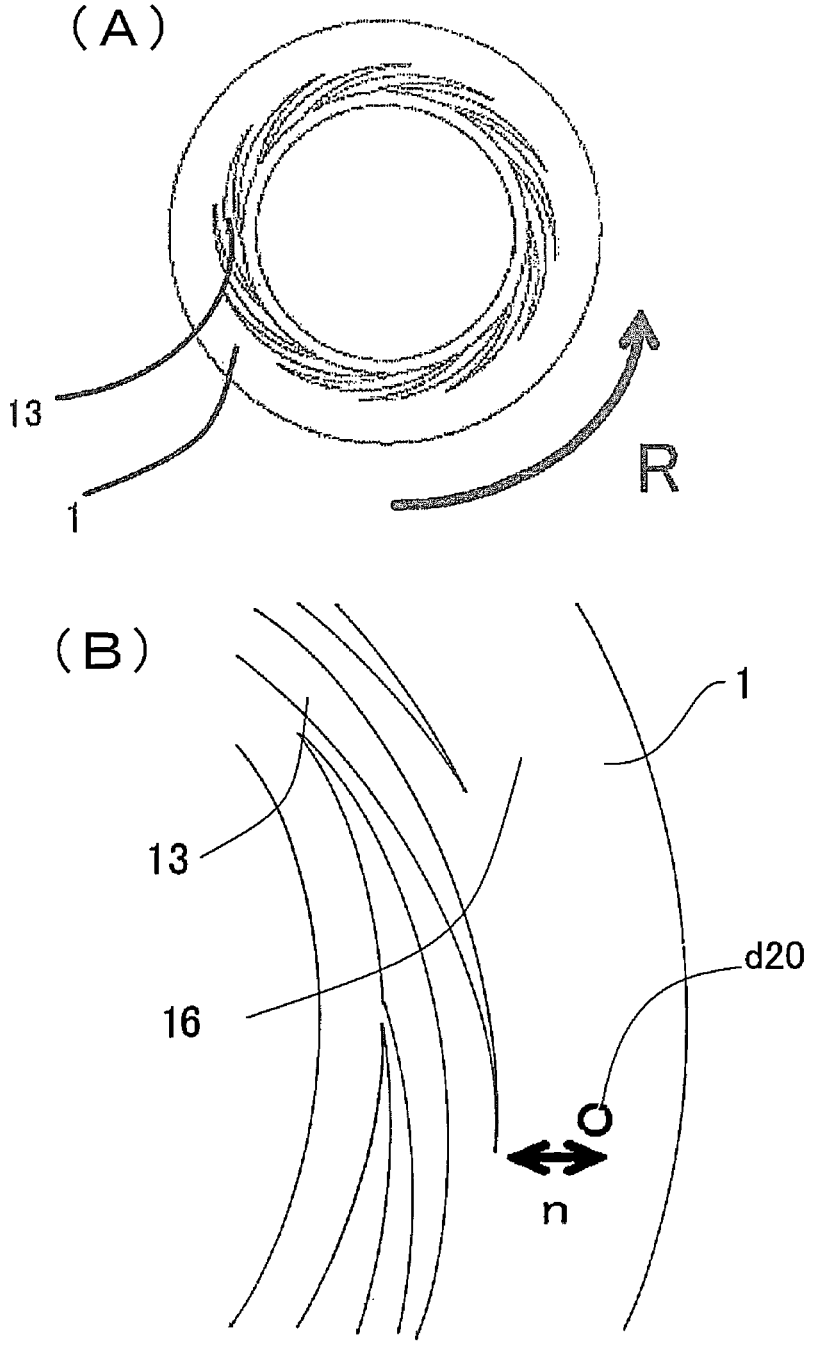
FIG. 2(A) is a schematic plane view of the first processing surface in the fluid processing apparatus shown in FIG. 1.
FIG. 2(B) is an enlarged view showing an important part of the processing surface in the apparatus.
Figure 3:
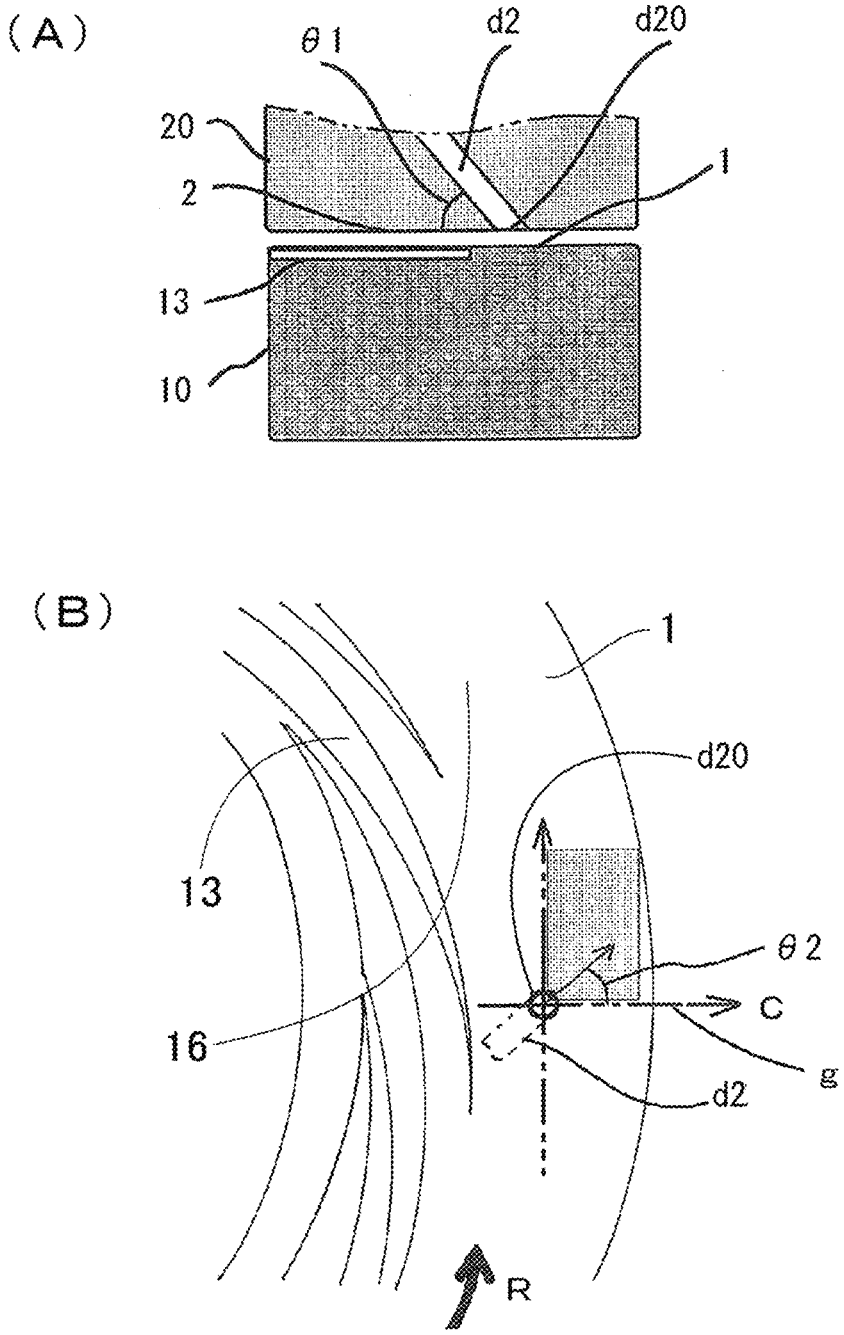
FIG. 3(A) is a sectional view of the second introduction member of the apparatus.
FIG. 3(B) is an enlarged view showing an important part of the processing surface for explaining the second introduction member.

The fluid processing apparatus shown in FIG. 1 to FIG. 3 is similar to the apparatus described in Patent Document 3, with which a material to be processed is processed between processing surfaces in processing members arranged so as to be able to approach to and separate from each other, at least one of which rotates relative to the other; wherein, of the fluids to be processed, a first fluid to be processed, i.e., a first fluid, is introduced into between the processing surfaces, and a second fluid to be processed, i.e., a second fluid, is introduced into between the processing surfaces from a separate path that is independent of the flow path introducing the first fluid and has an opening leading to between the processing surfaces, whereby the first fluid and the second fluid are mixed and stirred between the processing surfaces. Meanwhile, in FIG. 1, a reference character U indicates an upside and a reference character S indicates a downside; however, up and down, front and back and right and left shown therein indicate merely a relative positional relationship and does not indicate an absolute position. In FIG. 2(A) and FIG. 3(B), reference character R indicates a rotational direction. In FIG. 3(C), reference character C indicates a direction of centrifugal force (a radial direction).

In this apparatus provided with processing surfaces arranged opposite to each other so as to be able to approach to and separate from each other, at least one of which rotates relative to the other, at least two kinds of fluids as fluids to be processed are used, wherein at least one fluid thereof contains at least one kind of material to be processed, a thin film fluid is formed by converging the respective fluids between these processing surfaces, and the material to be processed is processed in this thin film fluid. With this apparatus, a plurality of fluids to be processed may be processed as mentioned above; but a single fluid to be processed may be processed as well.

This fluid processing apparatus is provided with two processing members of a first processing member 10 and a second processing member 20 arranged opposite to each other, wherein at least one of these processing members rotates. The surfaces arranged opposite to each other of the respective processing members 10 and 20 are made to be the respective processing surfaces. The first processing member 10 is provided with a first processing surface 1 and the second processing member 20 is provided with a second processing surface 2.

The processing surfaces 1 and 2 are connected to a flow path of the fluid to be processed and constitute part of the flow path of the fluid to be processed. Distance between these processing surfaces 1 and 2 can be changed as appropriate; and thus, the distance thereof is controlled so as to form a minute space usually in the range of 1 mm or less, for example, 0.1 □m to 50 □m. With this, the fluid to be processed passing through between the processing surfaces 1 and 2 becomes a forced thin film fluid forced by the processing surfaces 1 and 2.

When a plurality of fluids to be processed are processed by using this apparatus, the apparatus is connected to a flow path of the first fluid to be processed whereby forming part of the flow path of the first fluid to be processed; and part of the flow path of the second fluid to be processed other than the first fluid to be processed is formed. In this apparatus, the two paths converge into one, and two fluids to be processed are mixed between the processing surfaces 1 and 2 so that the fluids may be processed by reaction and so on. It is noted here that the term "process(ing)" includes not only the embodiment wherein a material to be processed is reacted but also the embodiment wherein a material to be processed is only mixed or dispersed without accompanying reaction.

To specifically explain, this apparatus is provided with a first holder 11 for holding the first processing member 10, a second holder 21 for holding the second processing member 20, a surface-approaching pressure imparting mechanism, a rotation drive mechanism, a first introduction part d1, a second introduction part d2, and a fluid pressure imparting mechanism p.

As shown in FIG. 2(A), in this embodiment, the first processing member 10 is a circular body, specifically a disk with a ring form. Similarly, the second processing member 20 is a circular disk. Material of the processing members 10 and 20 is not only metal and carbon but also ceramics, sintered metal, abrasion-resistant steel, sapphire, and other metal subjected to hardening treatment, and rigid material subjected to lining, coating, or plating. In the processing members 10 and 20 of this embodiment, at least part of the first and the second surfaces 1 and 2 arranged opposite to each other is mirror-polished.

Roughness of this mirror polished surface is not particularly limited; but surface roughness Ra is preferably 0.01 μm to 1.0 μm, or more preferably 0.03 μm to 0.3 μm.

At least one of the holders can rotate relative to the other holder by a rotation drive mechanism such as an electric motor (not shown in drawings). A reference numeral 50 in FIG. 1 indicates a rotary shaft of the rotation drive mechanism; in this embodiment, the first holder 11 attached to this rotary shaft 50 rotates, and thereby the first processing member 10 attached to this first holder 11 rotates relative to the second processing member 20. As a matter of course, the second processing member 20 may be made to rotate, or the both may be made to rotate. Further in this embodiment, the first and second holders 11 and 21 may be fixed, while the first and second processing members 10 and 20 may be made to rotate relative to the first and second holders 11 and 21.

At least any one of the first processing member 10 and the second processing member 20 is able to approach to and separate from at least any other member, thereby the processing surfaces 1 and 2 are able to approach to and separate from each other.

In this embodiment, the second processing member 20 approaches to and separates from the first processing member 10, wherein the second processing member 20 is accepted in an accepting part 41 arranged in the second holder 21 so as to be able to rise and set. However, as opposed to the above, the first processing member 10 may approach to and separate from the second processing member 20, or both the processing members 10 and 20 may approach to and separate from each other.

This accepting part 41 is a concave portion for mainly accepting that side of the second processing member 20 opposite to the second processing surface 2, and this concave portion is a groove being formed into a circle, i.e., a ring when viewed in a plane. This accepting part 41 accepts the second processing member 20 with sufficient clearance so that the second processing member 20 may rotate. Meanwhile, the second processing member 20 may be arranged so as to be movable only parallel to the axial direction; alternatively, the second processing member 20 may be made movable, by making this clearance larger, relative to the accepting part 41 so as to make the center line of the processing member 20 inclined, namely unparallel, to the axial direction of the accepting part 41, or movable so as to depart the center line of the processing member 20 and the center line of the accepting part 41 toward the radius direction.

It is preferable that the second processing member 20 be accepted by a floating mechanism so as to be movable in the three dimensional direction, as described above.

The fluids to be processed are introduced into between the processing surfaces 1 and 2 from the first introduction part d1 and the second introduction part d2, the flow paths through which the fluids flow, under the state that pressure is applied thereto by a fluid pressure imparting mechanism p consisting of various pumps, potential energy, and so on. In this embodiment, the first introduction part d1 is a path arranged in the center of the circular, second holder 21, and one end thereof is introduced into between the processing surfaces 1 and 2 from inside the circular, processing members 10 and 20. Through the second introduction part d2, the first fluid to be processed and the second fluid to be processed for reaction are introduced into between the processing surfaces 1 and 2. In this embodiment, the second introduction part d2 is a path arranged inside the second processing member 20, and one end thereof is open at the second processing surface 2. The first fluid to be processed which is pressurized with the fluid pressure imparting mechanism p is introduced from the first introduction part d1 to the space inside the processing members 10 and 20 so as to pass through between the first and processing surfaces 1 and 2 to outside the processing members 10 and 20. From the second introduction part d2, the second fluid to be processed which is pressurized with the fluid pressure imparting mechanism p is provided into between the processing surfaces 1 and 2, whereat this fluid is converged with the first fluid to be processed, and there, various fluid processing such as mixing, stirring, emulsification, dispersion, reaction, deposition, crystallization, and separation are effected, and then the fluid thus processed is discharged from the processing surfaces 1 and 2 to outside the processing members 10 and 20. Meanwhile, an environment outside the processing members 10 and 20 may be made negative pressure by a vacuum pump.

The surface-approaching pressure imparting mechanism mentioned above supplies the processing members with force exerting in the direction of approaching the first processing surface 1 and the second processing surface 2 each other. In this embodiment, the surface-approaching pressure imparting mechanism is arranged in the second holder 21 and biases the second processing member 20 toward the first processing member 10.

The surface-approaching pressure imparting mechanism is a mechanism to generate force (hereinafter, surface-approaching pressure) to press the first processing surface 1 of the first processing member 10 and the second processing surface 2 of the second processing member 20 in the direction to make them approach to each other. The mechanism generates a thin film fluid having minute thickness in a level of nanometer or micrometer by the balance between the surface-approaching pressure and the force to separate the processing surfaces 1 and 2 from each other, i.e., the force such as the fluid pressure. In other words, the distance between the processing surfaces 1 and 2 is kept in a predetermined minute distance by the balance between these forces.

In the embodiment shown in FIG. 1, the surface-approaching pressure imparting mechanism is arranged between the accepting part 41 and the second processing member 20. Specifically, the surface-approaching pressure imparting mechanism is composed of a spring 43 to bias the second processing member 20 toward the first processing member 10 and a biasing-fluid introduction part 44 to introduce a biasing fluid such as air and oil, wherein the surface-approaching pressure is provided by the spring 43 and the fluid pressure of the biasing fluid. The surface-approaching pressure may be provided by any one of this spring 43 and the fluid pressure of this biasing fluid; and other forces such as magnetic force and gravitation may also be used. The second processing member 20 recedes from the first processing member 10 thereby making a minute space between the processing surfaces by separating force, caused by viscosity and the pressure of the fluid to be processed applied by the fluid pressure imparting mechanism p, against the bias of this surface-approaching pressure imparting mechanism. By this balance between the surface-approaching pressure and the separating force as mentioned above, the first processing surface 1 and the second processing surface 2 can be set with the precision of a micrometer level; and thus the minute space between the processing surfaces 1 and 2 may be set. The separating force mentioned above includes fluid pressure and viscosity of the fluid to be processed, centrifugal force by rotation of the processing members, negative pressure when negative pressure is applied to the biasing-fluid introduction part 44, and spring force when the spring 43 works as a pulling spring. This surface-approaching pressure imparting mechanism may be arranged also in the first processing member 10, in place of the second processing member 20, or in both the processing members.

To specifically explain the separation force, the second processing member 20 has the second processing surface 2 and a separation controlling surface 23 which is positioned inside the processing surface 2 (namely at the entering side of the fluid to be processed into between the first and second processing surfaces 1 and 2) and next to the second processing surface 2. In this embodiment, the separation controlling surface 23 is an inclined plane, but may be a horizontal plane. The pressure of the fluid to be processed acts to the separation controlling surface 23 to generate force directing to separate the second processing member 20 from the first processing member 10. Therefore, the second processing surface 2 and the separation controlling surface 23 constitute a pressure receiving surface to generate the separation force.

In the example shown in FIG. 1, an approach controlling surface 24 is formed in the second processing member 20. This approach controlling surface 24 is a plane opposite, in the axial direction, to the separation controlling surface 23 (upper plane in FIG. 1) and, by action of pressure applied to the fluid to be processed, generates force of approaching the second processing member 20 toward the first processing member 10.

Meanwhile, the pressure of the fluid to be processed exerted on the second processing surface 2 and the separation controlling surface 23, i.e., the fluid pressure, is understood as force constituting an opening force in a mechanical seal. The ratio (area ratio A1/A2) of a projected area A1 of the approach controlling surface 24 projected on a virtual plane perpendicular to the direction of approaching and separating the processing surfaces 1 and 2, that is, in the direction of rising and setting of the second processing member 20 (axial direction in FIG. 1), to a total area A2 of the projected area of the second processing surface 2 of the second processing member 20 and the separation controlling surface 23 projected on the virtual plane is called as balance ratio K, which is important for control of the opening force. This opening force can be controlled by the pressure of the fluid to be processed, i.e., the fluid pressure, by changing the balance line, i.e., by changing the area A1 of the approach controlling surface 24.

Sliding surface actual surface pressure P, i.e., the fluid pressure out of the surface-approaching pressures, is calculated according to the following equation:

$$P=P1\times(K-k)+Ps$$

Here, P1 represents the pressure of a fluid to be processed, i.e., the fluid pressure, K represents the balance ratio, k represents an opening force coefficient, and Ps represents a spring and back pressure.

By controlling this balance line to control the sliding surface actual surface pressure P, the space between the processing surfaces 1 and 2 is formed as a desired minute space, thereby forming a fluid film of the fluid to be processed so as to make the processed substance such as a product fine and to effect uniform processing by reaction.

Meanwhile, the approach controlling surface 24 may have a larger area than the separation controlling surface 23, though this is not shown in the drawing.

The fluid to be processed becomes a forced thin film fluid by the processing surfaces 1 and 2 that keep the minute space therebetween, whereby the fluid is forced to move out from the circular, processing surfaces 1 and 2. However, the first processing member 10 is rotating; and thus, the mixed fluid to be processed does not move linearly from inside the circular, processing surfaces 1 and 2 to outside thereof, but does move spirally from the inside to the outside thereof by a resultant vector acting on the fluid to be processed, the vector being composed of a moving vector toward the radius direction of the circle and a moving vector toward the circumferential direction.

Meanwhile, a rotary shaft 50 is not only limited to be placed vertically, but may also be placed horizontally, or at a slant. This is because the fluid to be processed is processed in a minute space between the processing surfaces 1 and 2 so that the influence of gravity can be substantially eliminated. In addition, this surface-approaching pressure imparting mechanism can function as a buffer mechanism of micro-vibration and rotation alignment by concurrent use of the foregoing floating mechanism with which the second processing Member 20 may be held displaceably.

In the first and second processing members 10 and 20, the temperature thereof may be controlled by cooling or heating at least any one of them; in FIG. 1, an embodiment having temperature regulating mechanisms J1 and J2 in the first and second processing members 10 and 20 is shown. Alternatively, the temperature may be regulated by cooling or heating the introducing fluid to be processed. These temperatures may be used to separate the processed substance or may be set so as to generate Benard convection or Marangoni convection in the fluid to be processed between the first and second processing surfaces 1 and 2.

As shown in FIG. 2, in the first processing surface 1 of the first processing member 10, a groove-like depression 13 extended toward an outer side from the central part of the first processing member 10, namely in a radius direction, may be formed. The depression 13 may be, as a plane view, curved or spirally extended on the first processing surface 1 as shown in FIG. 2(B), or, though not shown in the drawing, may be extended straight radially, or bent at a right angle, or jogged; and the concave portion may be continuous, intermittent, or branched. In addition, this depression 13 may be formed also on the second processing surface 2, or on both the first and second processing surfaces 1 and 2. By forming the depression 13 as mentioned above, the micro-pump effect can be obtained so that the fluid to be processed may be sucked into between the first and second processing surfaces 1 and 2.

It is preferable that the base edge of this depression 13 reach the inner periphery of the first processing member 10. The front edge of the depression 13 is extended to the direction of the outer periphery of the first processing surface 1; the depth thereof (cross section area) is made gradually shallower (smaller) from the base edge to the front edge.

Between the front edge of the depression 13 and the outer peripheral of the first processing surface 1 is formed the flat plane 16 not having the depression 13.

When an opening d20 of the second introduction part d2 is arranged in the second processing surface 2, the arrangement is done preferably at a position opposite to the flat surface 16 of the first processing surface 1 arranged at a position opposite thereto.

This opening d20 is arranged preferably in the downstream (outside in this case) of the depression 13 of the first processing surface 1. The opening is arranged especially preferably at a position opposite to the flat surface 16 located nearer to the outer diameter than a position where the direction of flow upon introduction by the micro-pump effect is changed to the direction of a spiral and laminar flow formed between the processing surfaces. Specifically, in FIG. 2(B), a distance n from the outermost side of the depression 13 arranged in the first processing surface 1 in the radial direction is preferably about 0.5 mm or more. Especially in the case of separating microparticles from a fluid, it is preferable that mixing of a plurality of fluids to be processed and separation of the microparticles therefrom be effected under the condition of a laminar flow.

This second introduction part d2 may have directionality. For example, as shown in FIG. 3(A), the direction of introduction from the opening d20 of the second processing surface 2 is inclined at a predetermined elevation angle (θ1) relative to the second processing surface 2. The elevation angle (θ1) is set at more than 0° and less than 90°, and when the reaction speed is high, the angle (θ1) is preferably set in the range of 1° to 45°.

In addition, as shown in FIG. 3(B), introduction from the opening d20 of the second processing surface 2 has directionality in a plane along the second processing surface 2. The direction of introduction of this second fluid is in the outward direction departing from the center in a radial component of the processing surface and in the forward direction in a rotation component of the fluid between the rotating processing surfaces. In other words, a predetermined angle (θ2) exists facing the rotation direction R from a reference line g, which is the line to the outward direction and in the radial direction passing through the opening d20. This angle (θ2) is also set preferably at more than 0° and less than 90°.

This angle (θ2) can vary depending on various conditions such as the type of fluid, the reaction speed, viscosity, and the rotation speed of the processing surface. In addition, it is also possible not to give the directionality to the second introduction part d2 at all.

In the embodiment shown in FIG. 1, kinds of the fluid to be processed and numbers of the flow path thereof are set two respectively; but they may be one, or three or more. In the embodiment shown in FIG. 1, the second fluid is introduced into between the processing surfaces 1 and 2 from the introduction part d2; but this introduction part may be arranged in the first processing member 10 or in both. Alternatively, a plurality of introduction parts may be arranged relative to one fluid to be processed. The opening for introduction arranged in each processing member is not particularly restricted in its form, size, and number; and these may be changed as appropriate. The opening for introduction may be arranged just before the first and second processing surfaces 1 and 2 or in the side of further upstream thereof.

Meanwhile, because it is good enough only if the reaction could be effected between the processing surfaces 1 and 2, as opposed to the foregoing method, a method wherein the second fluid is introduced from the first introduction part d1 and a solution containing the first fluid is introduced from the second introduction part d2 may also be used. That is, the expression "first" or "second" for each fluid has a meaning for merely discriminating an $n^{th}$ fluid among a plurality of the fluids present; and therefore, a third or more fluids can also exist.

In the above-mentioned apparatus, a treatment such as separation/precipitation and crystallization is effected while the fluids are being mixed forcibly and uniformly between the processing surfaces 1 and 2 which are disposed in a position they are faced with each other so as to be able to approach to and separate from each other, at least one of which rotates relative to the other, as shown in FIG. 1. Particle diameter and monodispersity of the treated substance to be processed can be controlled by appropriately controlling rotation speed of the processing members 10 and 20, distance between the processing surfaces 1 and 2, concentration of raw materials in the fluids to be processed, kind of solvents in the fluids to be processed, and so forth.

Hereunder, specific embodiments as to the method for producing metal microparticles by using the above-mentioned apparatus will be explained.

In the apparatus, the metal solution in which at least any one of a metal and a metal compound or both are dissolved in a solvent and the reducing fluid in which at least one reducing agent is contained are mixed in the thin fluid formed between the processing surfaces which are disposed in a position they are faced with each other so as to be able to approach to and separate from each other, at least one of which rotates relative to the other, thereby separating metal microparticles having particle diameter thereof controlled. On this occasion, the particle diameter of metal microparticles is controlled by changing a specific condition with regard to at least either one of the metal solution or the reducing fluid to be introduced into between the processing surfaces 1 and 2. Here, the specific condition is at least one condition selected from the group consisting of the introduction velocity of at least any one of the metal solution and the reducing fluid and pH of at least any one of the metal solution and the reducing fluid.

The reaction to separate the metal microparticles takes place in the apparatus as shown in FIG. 1 of the present application while the fluids are being mixed forcibly and uniformly between the processing surfaces 1 and 2 which are disposed in a position they are faced with each other so as to be able to approach to and separate from each other, at least one of which rotates relative to the other.

At first, the reducing fluid in which at least one reducing agent is contained is introduced as the first fluid from the first introduction part d1, which is one flow path, into between the processing surfaces 1 and 2 which are disposed in a position they are faced with each other so as to be able to approach to and separate from each other, at least one of which rotates relative to the other, thereby forming between the processing surfaces a first fluid film which is a thin film fluid formed of the first fluid.

Then, the metal solution in which at least any one of the metal and the metal compound or both are dissolved in a solvent is introduced as the second fluid directly into the first fluid film formed between the processing surfaces 1 and 2 from the second introduction part d2 which is another flow path.

By so doing, the first fluid and the second fluid are mixed between the processing surfaces 1 and 2 while the distance therebetween is fixed by pressure balance between the supply pressure of the fluids to be processed and the pressure that is applied between the rotating processing surfaces, thereby effecting the reaction to separate the metal microparticles having particle diameter thereof controlled.

Meanwhile, because it is good enough only if the reaction could be effected between the processing surfaces 1 and 2, as opposed to the foregoing method, a method wherein the second fluid is introduced from the first introduction part d1 and a solution containing the first fluid is introduced from the second introduction part d2 may also be used. That is, the expression "first" or "second" for each fluid has a meaning for merely discriminating an $n^{th}$ fluid among a plurality of the fluids present; and therefore, a third or more fluids can also exist.

As mentioned before, the processing apparatus may be provided with, in addition to the first introduction part d1 and the second introduction part d2, the third introduction part d3; and in this case, for example, each of the fluids which contain a later-mentioned pH-controlling agent may be introduced into the processing apparatus as the first fluid, the second fluid, and the third fluid. By so doing, concentration and pressure of each solution can be controlled separately so that the separation reaction and the particle diameter of metal microparticles may be controlled more precisely. Meanwhile, a combination of the fluids to be processed (first to third fluids) that are introduced into each of the introduction parts may be set arbitrarily. The same is applied if the fourth or more introduction parts are arranged; and by so doing, fluids to be introduced into the processing apparatus may be subdivided. In this case, the pH-controlling agent may be contained at least in the third fluid, at least in either one of the first fluid or the second fluid, or neither in the first fluid nor the second fluid.

In addition, temperatures of the fluids to be processed such as the first fluid and the second fluid may be controlled; and temperature difference among the first fluid, the second fluid, and so on (namely, temperature difference among each of the supplied fluids to be processed) may be controlled either. To control temperature and temperature difference of each of the supplied fluids to be processed, a mechanism with which temperature of each of the fluids to be processed is measured (temperature of the fluid before introduction to the processing apparatus, or in more detail, just before introduction into between the processing surfaces 1 and 2) so that each of the fluids to be processed that is introduced into between the processing surfaces 1 and 2 may be heated or cooled may be installed.

Change of the Introduction Velocity:

In the present invention, particle diameter of the obtained metal microparticles may be controlled by changing the introduction velocity of at least any one of the metal solution and the reducing fluid to be introduced into between the processing surfaces 1 and 2. When this method is used, there is a merit that the mixing ratio of the reducing agent to the metal or the metal compound can be readily controlled by mere changing of the introduction velocity of at least any one of the metal solution and the reducing fluid; and as a result, the particle diameter of metal micoparticles can be readily controlled, so that it became possible to selectively produce metal microparticles having different targeted particle diameters without investigation of complicated treatment conditions that had been required before.

The method to change the introduction velocity of at least any one of the metal solution and the reducing fluid to be introduced into between the processing surfaces 1 and 2 is not particularly restricted. The introduction velocity of at least any one of the metal solution and the reducing fluid to be introduced into between the processing surfaces 1 and 2 may be changed by using the fluid pressure imparting mechanism p of the fluid processing apparatus, or the introduction velocity of at least any one of the metal solution and the reducing fluid to be introduced into between the processing surfaces 1 and 2 may be changed by using a fluid sending equipment such as a pump. A combined embodiment of the fluid pressure imparting mechanism p and the fluid sending equipment such as a pump may also be used.

Control of pH:

In the present invention, particle diameter of the metal micorparticles can be controlled readily by changing pH of at least any one of the metal solution and the reducing fluid to be introduced into between the processing surfaces 1 and 2. Specifically, though not particularly restricted, pH may be changed by containing the later-mentioned pH controlling agent in at least any one of the metal solution and the reducing fluid; or pH may be changed by changing dissolving concentration of any one of the metal and the metal compound or both (raw materials) in a solvent, or by changing concentration of the reducing agent contained in the reducing fluid. Alternatively, pH of at least any one of the metal solution and the reducing fluid may be changed by methods such as the method in which a plurality of the metal and the metal compound or both are dissolved in a solvent and the method in which the reducing fluid is made to contain a plurality of reducing agents. By the pH controlling methods as mentioned above, particle diameter of the metal microparticles can be readily controlled; and thus, metal microparticles having intended particle diameters according to an object may be selectively produced.

Substances for pH Control:

As to the pH control substance to control pH, there is no particular restriction; and illustrative example thereof includes an inorganic or an organic acidic substance such as hydrochloric acid, sulfuric acid, nitric acid, aqua regia, trichloroacetic acid, trifluoroacetic acid, phosphoric acid, citric acid, and ascorbic acid; a basic substance including alkaline hydroxides such as sodium hydroxide and potassium hydroxide, and amines such as triethylamine and dimethylaminoethanol; and salts of the acidic substances and basic substances. The pH controlling agents each may be used singly or as a mixture of two or more of them. By changing the mixing amount of the pH controlling agent into anyone of the metal solution and the reducing fluid, or by changing concentration of any one of the metal solution and the reducing fluid, pH of at least any one of the metal solution and the reducing fluid can be changed.

The pH controlling agent may be contained in the metal solution, or in the reducing fluid, or in the both fluids. Alternatively, the pH controlling agent may be contained in a third fluid that is different from the metal solution and the reducing fluid.

Range of pH:

In the present invention, pH of any one of the metal solution and the reducing fluid or both is not particularly restricted; the pH can be appropriately changed in accordance with the kind of the metal to be used, the particle diameter to be targeted, and so forth.

Dispersing Agent and So Forth:

In the present invention, various dispersing agents and surfactants may be used in accordance with the purpose and the necessity. Though not particularly restricted, various commercially available general surfactants and dispersing agents as well as a newly synthesized substance may be used. Illustrative example thereof includes an anionic surfactant, a cationic surfactant, a nonionic surfactant, as well as a dispersing agent such as various polymers. These may be used singly or as a combination of two or more of them.

The surfactants and dispersing agents may be contained in the metal solution, in the reducing fluid, or in the both fluids. Alternatively, the surfactants and the dispersing agents may be contained in a third fluid that is different from the metal solution and the reducing fluid.

Temperature:

In the present invention, temperature at the time of mixing of the metal solution with the reducing fluid is not particularly restricted. Temperature may be appropriately selected in accordance with the kind of the reducing agent and the kind of any one of the metal and the metal compound or both to be used, the kind of the metal to be targeted, the pH, and so forth.

Metal Microparticle:

The metal microparticle of the present invention may be a metal alloy microparticle formed of a plurality of metal elements and a microparticle formed of a metal element and a non-metal element, in addition to a microparticle of a single metal element. Furthermore, the metal microparticle of the present invention may contain non-metal elements of B, Si, Ge, As, Sb, C, N, O, S, Te, Se, F, Cl, Br, I, and At as the metal element.

In addition, practically the metal microparticle of the present invention may partially contain an oxide, a hydroxide, a hydroxylated oxide, and so forth.

EXAMPLES

Hereinafter, the present invention will be explained in more detail by Examples; but the present invention is not limited only to these Examples.

It is to be noted here that the term "from the center" in the following Examples means "from the first introduction part d1" of the processing apparatus shown in FIG. 1; the first fluid means the first fluid to be processed that is introduced through the first introduction part d1 of the processing apparatus as described before; and the second fluid means the second fluid to be processed that is introduced through the second introduction part d2 of the processing apparatus shown in FIG. 1, as described before.

Measurement of pH:

Measurement of pH was made by using a pH meter (Type D-51, manufactured by Horiba Ltd.). Before introducing each of the fluids to be processed into the fluid processing apparatus, pH of each of the fluids to be processed was measured at room temperature.

Observation with Scanning Electron Microscope:

Observation with a scanning electron microscope (SEM) was made by using a field-emission type scanning electron microscope (FE-SEM) (JSM-7500F, manufactured by JEOL Ltd.).

In Examples 1 to 10, a nickel solution using nickel sulfate hexahydrate as the metal compound and a reducing solution using hydrazine monohydrate as the reducing agent were mixed in a thin film fluid formed between the processing surfaces 1 and 2 by using an apparatus based on the same principle as the apparatus described in the Patent document 3 as shown in FIG. 1, whereby separating nickel microparticles as the metal microparticle in the thin film fluid. On this occasion, at least one condition selected from the group consisting of the introduction velocity of at least any one of the nickel solution and the reducing solution and pH of at least any one of the nickel solution and the reducing solution was changed thereby controlling particle diameter of the nickel microparticles.

The reducing solution was introduced as the first fluid from the center with the supply pressure of 0.50 MPaG, the rotation speed of 2000 rpm, and the supply temperature of 110° C., while the nickel solution was introduced as the second fluid with supply temperature of 25° C. into between the processing surfaces 1 and 2, thereby mixing the first fluid and the second fluid in the thin film fluid. Each of the supply temperatures of the first fluid and the second fluid was measured just before introduction of the first fluid and the second fluid into the processing apparatus (in more detail, just before introduction into between the processing surfaces 1 and 2). At this time, pH of the first fluid was 13.2. A dispersion solution containing the nickel microparticles was discharged from the processing surfaces. The discharged dispersion solution of the nickel microparticles was put on a magnet to deposit the nickel microparticles; and after the supernatant solution thereof was removed, the microparticles were washed by methanol for three times and then dried under the atmospheric pressure at 25° C. The XRD of the nickel microparticle powders after drying was measured; and as a result, it was confirmed that the nickel microparticles not containing impurities were produced.

The particle diameter of the nickel microparticles was confirmed by observation with SEM to judge the diameter of the primary particles thereof. The SEM observation was made with observation magnification of 5,000 or more, and then the average value of three spots was taken. In Table 1, treatment conditions and particle diameter of the obtained nickel microparticles are shown. In FIG. 4, the SEM picture of the nickel microparticles obtained in Example 1 is shown; and in FIG. 5, the SEM picture of the nickel microparticles obtained in Example 8 is shown.

TABLE 1

| | First fluid | | Second fluid | | | |
|---|---|---|---|---|---|---|
| Example | Kind | Introduction velocity [mL/minute] | Kind | pH | Introduction velocity [mL/minute] | Particle diameter [nm] |
| 1 | 2 wt % hydrazine monohydrate/ 0.15 wt % KOH/ethylene glycol solution | 400 | 5 wt % nickel sulfate hexahydrate aq. solution | 3.25 | 2.5 | 50 |
| 2 | | 400 | | | 5 | 100 |
| 3 | | 400 | | | 10 | 500 |
| 4 | | 200 | | | 2.5 | 100 |
| 5 | | 400 | 5 wt % nickel sulfate hexahydrate 0.2 wt % aq. nitric acid solution | 2.14 | 5 | 200 |
| 6 | | 400 | 5 wt % nickel sulfate hexahydrate 28.5 wt % aq. ammonia solution | 11.63 | 5 | 300 |
| 7 | | 500 | 35 wt % nickel nitrate hexahydrate aq. solution | 1.75 | 5 | 300 |
| 8 | | 500 | | | 10 | 1100 |
| 9 | | 500 | 35 wt % nickel nitrate hexahydrate 2.3 wt % aq. nitric acid solution | 0.23 | 5 | 200 |
| 10 | | 500 | 35 wt % nickel nitrate hexahydrate 19.5 wt % aq. ammonia solution | 5.91 | 5 | 300 |

From FIG. 4 to FIG. 5 and Table 1, it was confirmed that particle diameter of the obtained nickel microparticles could be controlled by changing at least one condition selected from the group consisting of the introduction velocity of at least any one of the nickel solution and the reducing solution and pH of at least any one of the nickel solution and the reducing solution.

Specifically, in Examples 1 to 3 in which pH values of the first fluid and the second fluid as well as the introduction velocity of the first fluid were made constant while the introduction velocity of the second fluid was changed, nickel microparticles having larger particle diameters were obtained with faster introduction velocity of the second fluid. In Examples 1 and 4 in which pH values of the first fluid and the second fluid as well as the introduction velocity of the second fluid were made constant while the introduction velocity of the first fluid was changed, nickel microparticles having larger particle diameters were obtained with slower introduction velocity of the first fluid.

In Examples 2 and Examples 5 to 6 in which the introduction velocities of the first fluid and the second fluids as well as pH value of the first fluid were made constant while the pH value of the second fluid was changed, nickel microparticles having different particle diameters could be obtained by changing the pH value of the second fluid.

In Examples 7 to 10 in which the dissolving concentration of the nickel compound was changed, similar tendency to Examples 1 to 6 was observed. From FIG. 4 to FIG. 5, it was confirmed that the obtained nickel microparticles had particle diameters thereof controlled uniformly and homogeneously.

In Examples 11 to 14, a tin solution using stannous chloride as the metal compound and a reducing solution using sodium borohydride as the reducing agent were mixed in the thin film fluid formed between the processing surfaces 1 and 2 by using an apparatus based on the same principle as the apparatus described in the Patent document 3 as shown in FIG. 1, whereby separating tin microparticles as the metal microparticle in the thin film fluid. On this occasion, at least one condition selected from the group consisting of the introduction velocity of at least any one of the tin solution and the reducing solution and pH of at least any one of the tin solution and the reducing solution was changed thereby controlling the particle diameter of the nickel microparticles.

The reducing solution was introduced as the first fluid from the center with the supply pressure of 0.50 MPaG, the rotation speed of 2000 rpm, and the supply temperature of 110° C., while the tin solution was introduced as the second fluid with supply temperature of 25° C. into between the processing surfaces 1 and 2, thereby mixing the first fluid and the second fluid in the thin film fluid. Each of the supply temperatures of the first fluid and the second fluid was measured just before introduction of the first fluid and the second fluid into the processing apparatus (in more detail, just before introduction into between the processing surfaces 1 and 2). At this time, pH of the first fluid was 14.1. A dispersion solution containing the tin microparticles was discharged from the processing surfaces.

The discharged dispersion solution of the tin microparticles was spun down by centrifugal separation; and after the supernatant solution thereof was removed, the microparticles were washed by methanol for three times and then dried under the atmospheric pressure at 25° C. The XRD of the tin microparticle powders after drying was measured; and as a result, it was confirmed that the tin microparticles not containing impurities were produced. The particle diameter of the tin microparticles was confirmed by observation with SEM to judge the diameter of the primary particles thereof. The SEM observation was made with observation magnification of 5,000 or more, and then the average value of three spots was taken. In Table 2, treatment conditions and particle diameter of the obtained tin microparticles are shown.

TABLE 2

| | First fluid | | Second fluid | | | |
|---|---|---|---|---|---|---|
| Example | Kind | Introduction velocity [mL/minute] | Kind | pH | Introduction velocity [mL/minute] | Particle diameter [nm] |
| 11 | 0.1 wt % $NaBH_4$/ 0.01 wt % aq. Ammonia solution | 200 | 1.63 wt % stannous chloride 0.07N aq. Hydrochloric acid solution | 0.35 | 50 | 500 |
| 12 | | 200 | 1.63 wt % | 0.18 | 5 | 50 |
| 13 | | 200 | stannous | | 10 | 100 |
| 14 | | 200 | chloride 0.7N aq. Hydrochloric acid solution | | 50 | 300 |

From Table 2, it was confirmed that particle diameter of the obtained tin microparticles could be controlled by changing at least one condition selected from the group consisting of the introduction velocity of at least any one of the tin solution and the reducing solution and pH of at least any one of the tin solution and the reducing solution. Specifically, in Examples 12 to 14 in which pH values of the first fluid and the second fluid as well as the introduction velocity of the first fluid were made constant while the introduction velocity of the second fluid was changed, the tin microparticles having larger particle diameters were obtained with faster introduction velocity of the second fluid.

In Examples 15 to 21, a gold solution using chlorauric acid as the metal compound and a reducing solution using iron sulfate as the reducing agent were mixed in the thin film fluid formed between the processing surfaces 1 and 2 by using an apparatus based on the same principle as the apparatus described in the Patent document 3 as shown in FIG. 1, whereby separating gold microparticles as the metal microparticle in the thin film fluid. On this occasion, at least one condition selected from the group consisting of the introduction velocity of at least any one of the gold solution and the reducing solution and pH of at least any one of the gold solution and the reducing solution was changed thereby controlling the particle diameter of the gold microparticles.

The reducing solution was introduced as the first fluid from the center with the supply pressure of 0.50 MPaG, the rotation speed of 2000 rpm, and the supply temperature of 25° C., while the gold solution was introduced as the second fluid with supply temperature of 25° C. into between the processing surfaces 1 and 2, thereby mixing the first fluid and the second fluid in the thin film fluid. Each of the supply temperatures of the first fluid and the second fluid was measured just before introduction of the first fluid and the second fluid into the processing apparatus (in more detail, just before introduction into between the processing surfaces 1 and 2). A dispersion solution containing the gold microparticles was discharged from the processing surfaces. The discharged dispersion solution of the gold microparticles was spun down by centrifugal separation; and after the supernatant solution thereof was removed, the microparticles were washed by methanol for three times and then dried under the atmospheric pressure at 25° C.

The XRD of the gold microparticle powders after drying was measured; and as a result, it was confirmed that the gold microparticles not containing impurities were produced. The particle diameter of the gold microparticles was confirmed by observation with SEM to judge the diameter of the primary particles thereof. The SEM observation was made with observation magnification of 5,000 or more, and then the average value of three spots was taken. In Table 3, treatment conditions and particle diameter of the obtained gold microparticles are shown.

TABLE 3

| | First fluid | | | Second fluid | | | |
|---|---|---|---|---|---|---|---|
| Example | Kind | Introduction velocity [mL/minute] | pH | Kind | pH | Introduction velocity [mL/minute] | Particle diameter [nm] |
| 15 | 10 wt % | 200 | 3.8 | 5 wt % | 1.23 | 5 | 100 |
| 16 | $FeSO_4 \cdot 7H_2O$ | | | $HAuCl_4 \cdot 4H_2O$ | | 50 | 300 |
| 17 | aq. solution | | | aq. solution | | 100 | 500 |
| 18 | 4 wt % | 200 | 4.16 | 1 wt % | 1.9 | 5 | 20 |
| 19 | $FeSO_4 \cdot 7H_2O$ | | | $HAuCl_4 \cdot 4H_2O$ | | 25 | 50 |
| 20 | aq. solution | | | 0.1 wt % | | 50 | 100 |
| 21 | | | | triethanolamine aq. solution | | 100 | 300 |

From Table 3, it was confirmed that particle diameter of the obtained gold microparticles could be controlled by changing at least one condition selected from the group consisting of the introduction velocity of at least any one of the gold solution and the reducing solution and pH of at least any one of the gold solution and the reducing solution. Specifically, in Examples 15 to 17 and Examples 18 to 21 in which pH values of the first fluid and the second fluid as well as the introduction velocity of the first fluid were made constant while the introduction velocity of the second fluid was changed, the gold microparticles having larger particle diameters were obtained with faster introduction velocity of the second fluid.

1 first processing surface
2 second processing surface
10 first processing member
11 first holder
20 second processing member
21 second holder
d1 first introduction part
d2 second introduction part
d20 opening

The invention claimed is:

1. A method for producing metal microparticles having different targeted particle diameters, comprising the steps of:

providing at least two kinds of fluid including a first fluid and a second fluid, the first fluid being a metal solution in which at least one kind of a metal, a metal compound, or a combination thereof are dissolved in a solvent, and the second fluid being a reducing fluid in which at least one kind of a reducing agent is contained;

providing at least two processing surfaces arranged facing with each other, the at least two processing surfaces being operable to approach to and separate from each other, at least one of the at least two processing surfaces rotating relative to the other;

introducing the at least two kinds of fluid into a space between the at least two processing surfaces;

passing the reducing fluid through a first flow path into the space between the at least two processing surfaces while forming a thin film fluid;

providing a second flow path independent of the first flow path, at least one opening leading to the second flow path being arranged in at least one of the at least two processing surfaces;

introducing the metal solution through the second flow path into the space between the at least two processing surfaces from the opening;

mixing the at least two kinds of fluid between the at least two processing surfaces to form the thin film fluid;

separating metal microparticles in the thin film fluid by reaction of the at least two kinds of fluid; and selectively producing metal microparticles with targeted particle diameters by changing an introduction velocity of the metal solution from the opening, wherein the metal solution is any one of a nickel solution in which a nickel compound is dissolved in a solvent; a tin solution in which a tin compound is dissolved in a solvent; a gold solution in which a gold compound is dissolved in a solvent;

wherein the reducing fluid is a reducing solution in which the reducing agent is mixed with or solved in a solvent; and wherein the metal microparticles are selectively produced such that the metal microparticles having larger particle diameters are obtained with a faster introduction velocity of the metal solution.

2. The method according to claim 1, further comprising the step of changing the pH value of the metal solution.

3. The method according to claim 1, wherein an introduction velocity of the reducing fluid to be introduced into the space between the at least two processing surfaces is faster than the introduction velocity of the metal solution.

4. The method according to claim 1, further comprising the step of changing an introduction velocity of the metal solution while maintaining an introduction velocity of the reducing fluid constant.

* * * * *